United States Patent [19]

Jacobson et al.

[11] 4,111,242

[45] Sep. 5, 1978

[54] WIRE WRAPPING AND CUT-OFF TOOL

[76] Inventors: Ronald H. Jacobson, 1055 Valley Lake Dr., Inverness (Palatine), Ill. 60067; Brian J. Miller, 4519 N. Moody, Chicago, Ill. 60630

[21] Appl. No.: 799,941

[22] Filed: May 24, 1977

[51] Int. Cl.[2] ..... B21F 3/00; B21F 15/00

[52] U.S. Cl. ..... 140/124; 242/7.17

[58] Field of Search ..... 7/14.1; 140/52, 57, 140/117, 118, 119, 122, 124, 149; 242/7.06, 7.17, 7.18; 29/751

[56] References Cited

U.S. PATENT DOCUMENTS

| | | | |
|---|---|---|---|
| 619,782 | 2/1899 | Noyes | 140/149 |
| 978,028 | 12/1910 | Kaspar | 140/52 |
| 2,492,228 | 12/1949 | Lee et al. | 140/149 |
| 2,652,074 | 9/1953 | Cantu | 140/124 |
| 2,824,475 | 2/1958 | Rolando | 140/123 X |
| 3,168,118 | 2/1965 | Holman | 140/149 X |
| 3,244,202 | 4/1966 | Huang | 242/7.17 X |
| 3,250,302 | 5/1966 | Zoltai | 140/124 X |
| 3,360,808 | 1/1968 | Taysom | 242/7.17 X |

OTHER PUBLICATIONS

Wire Wrapping Stylus, Bajan et al - IBM Technical Disclosure Bulletin, vol. 14, No. 7, Dec. 1971.

*Primary Examiner*—E. M. Combs

*Attorney, Agent, or Firm*—Hill, Gross, Simpson, Van Santen, Steadman, Chiara & Simpson

[57] ABSTRACT

A tool for wrapping wire on a terminal post which includes a rod-like member having an axial end face with a terminal pin receiving bore therein. A configuration on the axial end face is provided to cause wire to wrap around the terminal when the rod is rotated. A slot open to the periphery of the rod is provided communicating with the axial end face, the slot lying on an angle to the axis. The slot extends partway through the rod forming a periphery which is axially spaced from the end face and which is axially arcuate on a radius having a center point at or spaced outward from the axial end face. The slot is adapted to receive the wire. The rod is axially movable with respect to a cut-off formed as an axial open end of a tubular member receiving the rod.

3 Claims, 6 Drawing Figures

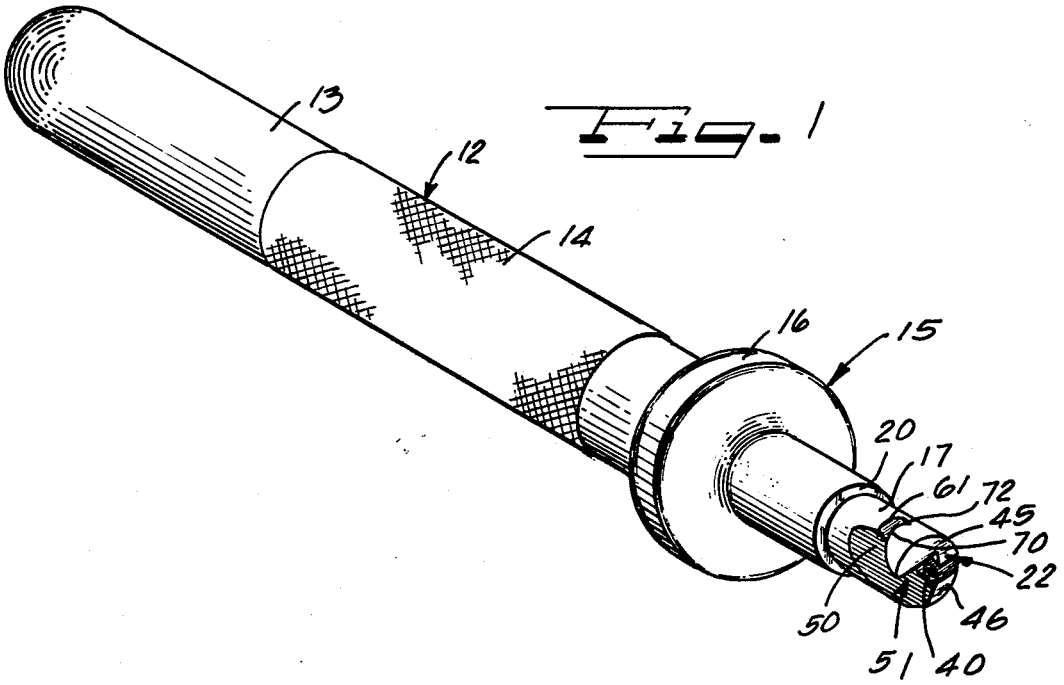
Fig. 1
Fig. 3
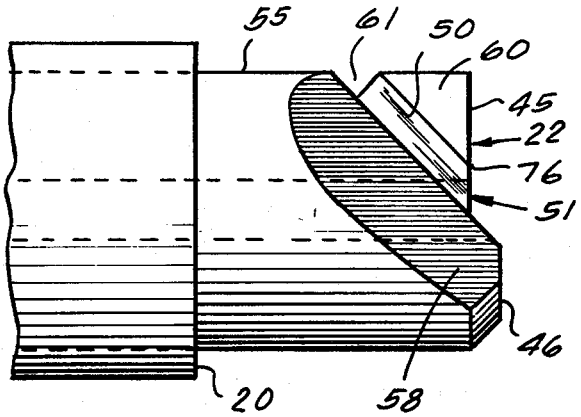
Fig. 4
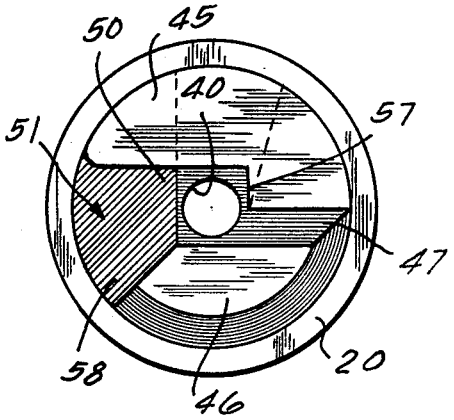

WIRE WRAPPING AND CUT-OFF TOOL

BACKGROUND OF THE INVENTION

1. Field of the Invention

This invention relates to tools and more particularly to a wire winding tool.

2. Prior Art

In the construction, assemblage, or hookup of electrical components it is frequently necessary to wrap a conductive wire around another member, generally describable as a terminal post or pin. In this wrapping, it is desired that the wire undergo a spiral wind on the post. Numerous tools have been developed to aid in accomplishing this winding. A presently available standard type includes a rod-like member having an axial end with a bore therethrough for receiving the terminal and a configuration for engaging the wire to direct the wire around the terminal with rotation of the rod. Configurations known include additional axial bores in the end face for receipt of the wire, recessed central area axial end faces with raised peripheries with or without axially open ended notches therein and axially projecting ribs, posts, and chamfer faces.

Such prior art tools are either small hand held units adapted to be rotated between the fingers or are units attachable to power tools or to hand actuated pistol grip-like rotators.

It is an advantage in the construction of such hand tools to make them relatively small as so that they can be easily and comfortably rotated between the thumb and forefinger of a user and can further be comfortably grasped by the hand. Further, simplification of end face design is desired so that one handed operation of the tool is facilitated since during use the other hand will normally be required to hold either the component having the terminal pin or the wire source or both. It is an additional advantage if the tool can be designed such that it can be grasped in the palm of the hand by the last two fingers so that the hand holding the tool, when the tool is not being used for winding, can aid in locating the wire adjacent the proper terminal.

All of the above factors can combine to create a tool which the user does not have to lay aside when wrapping wire on a succession of terminals on either the same or a succession of articles.

Although prior designs have, in some instances, achieved one or more of the above objectives, their versatility and usefulness is limited by the fact that the operator must put the tool down in order to grasp another tool to cut off the excess wire. Further, in connection with many of the previous designs, it is possible for the wire to slip out of contact with the end face configuration which is to insure rotation of the wire with the hand tool. Additionally many prior art tools of this type, although useful in winding the wire, have not been successful in dressing the wire down on the terminal into axially tight engaged coils.

It would therefore be an advance in the art to provide a wire wrap tool having a simplified construction which will easily and securingly grasp the wire and wind it around a terminal, which will dress the wire down on the terminal and which will sever any excess wire. It would be an even greater advance if such a tool could perform the function of grasping the wire, winding the wire, dressing the wire, and cutting the wire on successive terminals without the necessity of laying the tool aside.

SUMMARY OF THE INVENTION

Our invention overcomes the disadvantages in the prior art and provides a tool with the above-described advantages. In the preferred embodiment illustrated the tool consists of an inner rod-like member having an axial free end, an outer tube-like member having an open axial end receiving the inner member, a spring urging the inner member out of open axial end of the outer member and a restraint limiting movement of the inner member totally out of the outer member. The inner member has an axial end face which has a central bore therein dimensioned to receive a terminal pin. A portion of the axial end face is axially raised from the remainder with the inter-section of the portion and the remainder lying substantially on a diameter passing through or adjacent the central bore. The raised portion provides a configuration which aids in causing the wire to wrap around a terminal received in the axial bore.

The rod is provided with a slot formed therein at an angle to the axis. The slot is open to the axial end face intersecting the axial end face at approximately the central bore and extending inwardly from the periphery of the rod past the center point of the axial end face. The slot itself has a relatively narrow width such that its opening at the periphery is axially arcuate while its opening at the axial end face is substantially straight. In this manner, the slot peripheral opening, as it extends circumferentially from the point of its throat opening at the periphery and the axial end face, is axially arcuate whereby a land exists between portions of the axial end face and the slot peripheral opening which land first increases in axial spacing from the axial end face and then decreases. In this manner, a wire inserted into the slot from the throat opening can reach an overcenter position with respect to the land such that further axial urging on the wire will force it into a blind corner formed in the terminus of the slot rather than forcing it out of the throat opening.

The axial end face of the outer tube-like member is formed as a shearing face with a cutting edge at its inner diameter. Thus a wire length, once received in the slot past the overcenter position will be cut by the cutting face when the cutting face moves axially towards the free end into engagement with the wire forcing the wire into the blind corner which prevents any further axial movement of the wire. Any further axial movement of the cutting face will then shear the wire.

It is therefore an object of this invention to provide a hand wire wrapping tool having an excess wire cutting face thereon.

It is another and more particular object of this invention to provide a wire wrapping tool having a wrapping member with a simplified end face design with a bore for receipt of a terminal pin, and an end face intersecting slot for receipt of the wire; upon rotation of the tool, the end face and slot cooperating in causing the wire to wrap around the terminal pin, a movable cutting face associated with the tool effective to shear any excess wire projecting from the slot upon completion of winding by initiating a movement between the cutting face and the slot without removing the terminal from the bore.

It is yet another and more particular object of this invention to provide a hand held wire wrapping and cut-off tool having a cylindrical first member with an axial end having a terminal pin receiving bore therein, a configuration at the axial end cooperating to wrap a wire around a terminal pin received in the bore upon rotation of the tool, the configuration including a slot open to the axial end and to the periphery of the first member at a point spaced from the axial end, the slot having an overcenter configuration at the periphery providing a blind corner remote from a throat opening to the slot at an intersection of the axial end and periphery, the blind corner being located axially such that a wire positioned in the corner will have to move axially away from the end face to reach the throat opening, a second outer member receiving the first member and having portions relatively movable axially of the first member towards the axial end past the blind corner, the portions of the second member including a shearing face.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure and in which:

BRIEF DESCRIPTION OF THE DRAWINGS

FIG. 1 is a perspective view of anembodiment of the tool of this invention.

FIG. 3 is an enlarged fragmentary elevational view of the working axial end of the tool of FIG. 1.

FIG. 4 is an end plan view of the end of FIG. 3.

DESCRIPTION OF THE PREFERRED EMBODIMENTS

Figure 2:
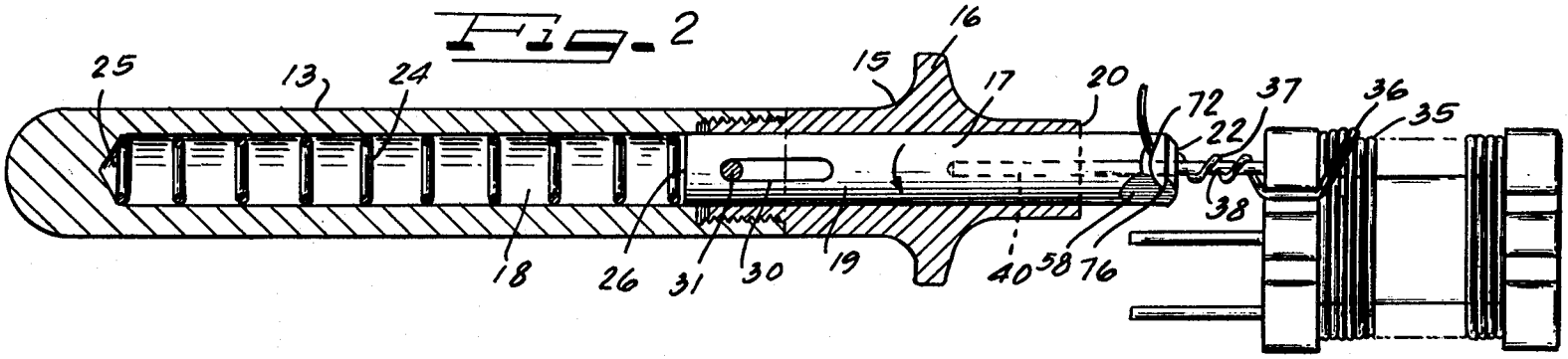
FIG. 2 is a cross-sectional view along the axial length of the tool of FIG. 1.

As best illustrated in FIGS. 1 and 2, the preferred hand tool embodiment of the wire wrapping and cut-off tool of this invention consists of a two piece outer member 12 including a test tube shaped grasping portion 13 having a knurled ring 14 and a tube-like shearing portion 15 having a radially extending flange 16 against which the thumb and forefinger of a user can abut for the application of axial force. An inner rod-like member 17 has an axial length 19 extending into the hollow interior 18 of the grasping portion 13 through the shearing portion 15 and projecting from an open end 20 of the shearing portion. The rod-like inner portion 17 terminates in an axial end face 22. A spring 24 is entrapped between the bottom 25 of the hollow interior 18 of the grasping portion 13 and an interior axial end 26 of the inner member 17. An elongated blind ended slot 30 extending through the portion 19 of the inner member cooperates with a lock pin 31 carried by the outer member 12 to restrict axial movement of the inner member with respect to the outer member and to lock the inner and outer members together for rotation.

A small coil 35 is illustrated in FIG. 2 having a winding wire 36 with a free end section 37 to be wrapped on a terminal pin 38. The inner member 17 has an axial bore 40 extending thereinto from the axial end face 22 and dimensioned to receive the terminal pin 38.

As best illustrated in FIGS. 1, 3 and 4, the axial end face has a base axial elevation section 45 on approximately one half of the end face with a raised portion 46 on approximately the other half of the axial end face, the two sections meeting at a sloping axial extending ledge 47 located substantially along a diameter. The raised portion 46 cooperates in forming a trailing ledge urging the wire to wrap around the terminal upon rotation of the too.

A slot 50 is formed into the body of the inner member from the peripheral outer wall thereof with the slot 50 intersecting with the axial end face at approximately the ledge diameter, the slot angled to the axis such that, except at a throat opening 51, it is open to the periphery 55 in axially spaced relation to the axial end face 22. The slot extends into the material of the inner member 17 slightly past the radius thereof and past the terminal receiving bore 40 where it terminates as at 57. The slot axially underlies the portion 45 and may have an angle of inclination to the axial end face which is the same as the inclined sloping ledge 47. A portion of the slot at the throat opening 51 may chamfered back as indicated at 58 of FIG. 4 in order to provide a wider throat opening. A land 60 is thus formed between the axial end face 22 and the slot opening 61 remote from the axial end face circumferentially displaced from the throat opening 51.

In the embodiment illustrated, the slot is straight, such as may be formed by a bandsaw and, therefore, due to the round cross section of the inner member 7, the slot will have an arcuate curvature at the periphery as indicated at 70 of FIG. 1. This arcuate curvature forms a blind corner 72 at the circumferential terminus of the peripheral opening of the slot. This blind corner is spaced closer to the axial end face 22 than are other portions of the slot intermediate the blind corner and the throat opening.

Due to the inclination of the slot 50, the land 60 has a point 76 at the throat opening which will aid in picking up the wire and causing it to enter the slot.

Operation of the tool is as follows. With the tool grasped in the palm of a hand of a user, a wire to be wrapped around the terminal is caused to be past over the terminal at an angle to the axis of the terminal. Thereafter with the tool grasped between the thumb and forefinger of the user adjacent the knurled ring 14, the terminal is inserted into the bore 40. The tool is then rotated while causing it to move axially on the terminal. This will result in the wire being directed into the throat opening 51 by the point 76. Further rotation of the tool will cause the free end of the wire to move into the blind corner of the slot with the wire extending out of the slot to the axial end face between the end of the slot 57 and the bore 40 and the wire then lying against the ledge 47. Further rotation of the tool will wrap the wire spirally on the terminal as illustrated in FIG. 2.

Figure 6:
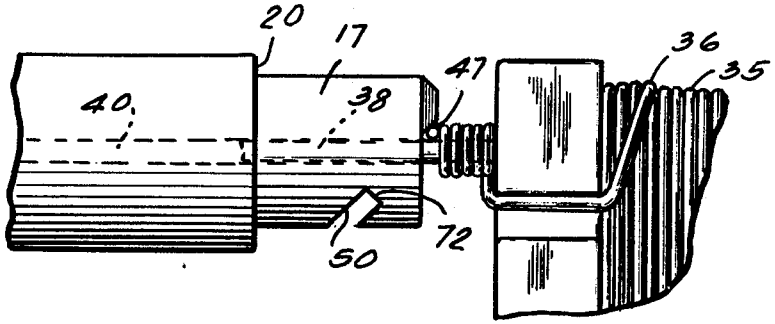
FIG. 6 is a view similar to FIG. 5 illustrating a stage in the removal of the tool from the terminal after shearing.
Figure 5:
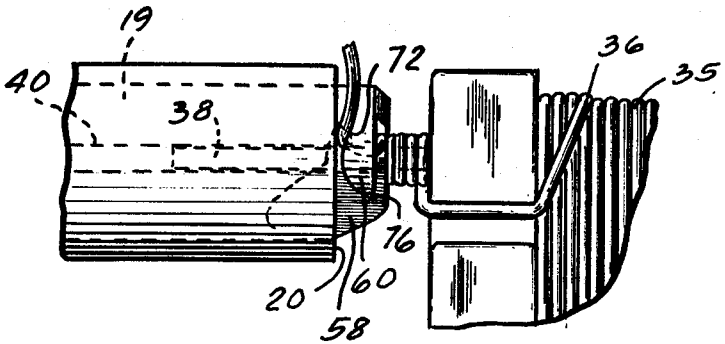
FIG. 5 is an enlarged elevational view of the working end of the tool at the time of shearing excess wire.

When a desired number of coils have been formed on the terminal, an axial movement of the outer member toward the base of the terminal will entrap the coils between the base o the terminal and the axial end face and will cause them to compress as illustrated in FIG. 5. During this axial movement, the excess wire cannot escape from the slot since it is trapped in the blind corner 72 as illustrated in FIG. 5 where the wire has been urged up against the land 60 by the partial telescoping of the inner member 17 into the outer member 12 which results in the open end face 20 of the shearing portion 15 moving to partially overlie the peripheral opening of the slot. Further axial pressure on the tool causing it to move towards the base of the terminal 38 will shear off the excess wire projecting from the blind corner 72. After shearing, additional rotation of the tool will cause the sheared end portion of the wire remaining in the slot to be wrapped around the terminal in a fully dressed down position as illustrated in FIG. 6.

Of course, it is to be understood that the tool will function as a wire wrapping tool and still be capable of properly dressing down the coils without shearing when desired since the axial force necessary to cause the coils to be properly dressed is not the same force necessary to shear them. However, when shearing of the excess wire is required, it can be accomplished by the tool disclosed herein without the necessity of using extra tools simply by undergoing a relative axial movement between the inner and outer members.

Although we have shown cylindrical inner and outer members, it is to be understood that other than circular cross sections can be used so long as the slot is formed with a blind corner requiring axial movement of the wire away from the axial end face 22 in order for the wire to slip out of the throat. It is this entrapment which allows sufficient force to be applied against the wire to cause shearing. Otherwise the wire would be forced out of the throat by the cutting edge of the open end face 20.

It is further to be understood that although we have shown a hand held tool as a preferred embodiment, other embodiments are conceivable, including a table mounted motor driven unit wherein the inner member will be positively rotated and the outer member may be axially movable under power with the inner member held stationary or the inner member may be axially movable with the outer member held stationary. Alternatively the outer member can be nothing more than a shear ring received around the inner member. In the preferred embodiment illustrated the shearing portion 15 is threaded onto the grasping portion 13 so that the shearing portion may be removed for flat grinding of the open end face to maintain the sharpness of the cutting edge formed at the inner diameter of the open end face 20.

It can therefore be seen from the above that our invention provides a combination wire wrapping and excess wire cut-off tool which will wrap a wire around a terminal and thereafter shear off excess wire while dressing down the coils of the wrapping without removal of the tool from the terminal.

Although the teachings of our invention have herein been discussed with reference to specific theories and embodiments, it is to be understood that these are by way of illustration only and that others may wish to utilize our invention in different designs or applications.

We claim:

1. In a wire wrapping tool having an axial end face with a bore therein for receiving a terminal pin around which a wire is to be wrapped and an end face configuration adapted to cause a wire to wrap around the pin upon rotation of the tool, the improvement of a blind slot extending partially through a body of the tool less than the full width of the body having one slot end open to the axial end face adjacent the bore and another slot end open to a periphery of the body spaced from the axial end face with a throat opening to the slot at the periphery of the axial end face, the body being elongated and the slot extending into the body transversely of the longitudinal extent thereof terminating interiorly of the body, the slot having a wire positioning means such that when a wire is received in the slot with wire ends exiting the slot at both the axial end face and at the periphery, the slot wire positioning means will prevent wire movement towards the throat when the wire is positioned at a certain point in the slot and when the wire projecting from the periphery undergoes movement towards the axial end face.

2. A wire wrapping and cut-off tool comprising a cylindrical body having a terraced end face with an axial high portion and an axial low portion with a wall joining the portions, a pin receiving axial bore extending into the body at the wall substantially centrally of the end face, a transverse blind slot extending chordally into the body from the periphery of the body at an angle to the axis open to the end face at the low portion adjacent the wall and to the periphery axially spaced from the end face with a land between the end face and the slot, the land defining a blind end of the slot closer to the end face than slot periphery opening portions intermediate the blind end and throat, the land providing a point like tip at the throat for directing a wire into the throat thence into the slot and an outer sleeve around said body on a side of the slot periphery opening opposite the end face, the sleeve having a cut-off edge surronding the body, the cut-off edge movable towards the end face to cut off a wire end trapped at the blind end.

3. The tool of claim 2 wherein the wall is angled to an axis of the body, the axial bore enxtends into the body through the wall, the slot having an inside face thereof defined by a body wall which is an extension of the wall joining the portions, the slot being chamfered back to enlarge the throat opening, the chamfer reducing the circumferential extent of the high portion.

* * * * *